US009417043B2

(12) United States Patent
Ohlson

(10) Patent No.: US 9,417,043 B2
(45) Date of Patent: Aug. 16, 2016

(54) THERMAL DESTRUCTION ARRANGEMENT

(71) Applicant: DYNASAFE DEMIL SYSTEMS AB, Karlskoga (SE)

(72) Inventor: Fredrik Ohlson, Torslanda (SE)

(73) Assignee: DYNASAFE DEMIL SYSTEMS AB, Karlskoga (SE)

( * ) Notice: Subject to any disclaimer, the term of this patent is extended or adjusted under 35 U.S.C. 154(b) by 0 days.

(21) Appl. No.: 14/781,426

(22) PCT Filed: May 21, 2014

(86) PCT No.: PCT/EP2014/060448
§ 371 (c)(1),
(2) Date: Sep. 30, 2015

(87) PCT Pub. No.: WO2014/191278
PCT Pub. Date: Dec. 4, 2014

(65) Prior Publication Data

US 2016/0054110 A1 Feb. 25, 2016

(30) Foreign Application Priority Data

May 28, 2013 (EP) ..... 13169543

(51) Int. Cl.
*F42B 33/06* (2006.01)
*F23G 5/44* (2006.01)
*F23G 5/50* (2006.01)

(52) U.S. Cl.
CPC ..... *F42B 33/067* (2013.01); *F23G 5/444* (2013.01); *F23G 5/50* (2013.01); *F23G 2203/601* (2013.01); *F23G 2205/18* (2013.01); *F23G 2207/20* (2013.01); *F23G 2209/16* (2013.01)

(58) Field of Classification Search
CPC ..... F42B 33/067; F42D 5/00; F42D 5/04; F23G 5/444; F23G 5/50; F23G 2203/601; F23G 2207/20; F23G 2209/16; F23G 2205/14; F23G 2205/16; F23G 2205/18
USPC ..... 86/50
See application file for complete search history.

(56) References Cited

U.S. PATENT DOCUMENTS 3,570,421 A * 3/1971 Flowers, Jr. ..... F23G 5/444 110/109
3,742,875 A * 7/1973 Eberle ..... F23G 5/444 110/116

(Continued)

FOREIGN PATENT DOCUMENTS

| | | |
|---|---|---|
| EP | 0109379 | 5/1984 |
| EP | 0898693 | 3/1999 |
| WO | 96/12157 | 4/1996 |

OTHER PUBLICATIONS

Renan Menier, International Search Report for related application PCT/EP2014/060448, Jul. 7, 2014, Rijswijk Netherlands.

*Primary Examiner* — Bret Hayes
(74) *Attorney, Agent, or Firm* — Babcock IP, PLLC

(57) ABSTRACT

A system for thermal destruction of munitions has a rotatable kiln with a duct opening. A gate pivotally connected to the duct is arranged to open and close the duct. A loading tray is pivotally connected to the duct such that with the kiln in a first position with the gate open, the loading tray may be pivoted to load the kiln. After a thermal destruction process, rotation of the kiln to a second position facilitates emptying of the kiln via the duct.

14 Claims, 4 Drawing Sheets

(56) References Cited

U.S. PATENT DOCUMENTS 3,820,435 A * 6/1974 Rogers ..... G01N 25/50 73/35.17
3,965,828 A * 6/1976 McRee, Jr. ..... F23G 5/442 110/116
4,187,758 A * 2/1980 Petty ..... F42D 5/04 109/74
4,437,382 A * 3/1984 Yerushalmi ..... F42D 5/04 86/50
4,551,051 A * 11/1985 Hofbauer ..... F23G 7/12 110/246
4,694,947 A * 9/1987 Nineberg ..... F23G 5/444 110/116
4,850,290 A * 7/1989 Benoit ..... C04B 7/4407 110/237
4,930,965 A 6/1990 Peterson et al.
5,078,594 A 1/1992 Tutt et al.
7,373,867 B2 * 5/2008 Ryan ..... F41H 13/0043 588/403
8,621,973 B2 * 1/2014 Abbe ..... F42D 5/045 86/50
2002/0017226 A1 * 2/2002 Largent ..... C04B 7/443 110/101 R
2003/0209133 A1 * 11/2003 Greenfield ..... F42D 5/04 86/50
2005/0120926 A1 * 6/2005 Pretzsch ..... F23G 5/444 110/242
2009/0044690 A1 * 2/2009 King ..... F42D 5/045 86/50
2009/0071319 A1 * 3/2009 Ohlson ..... F42D 5/04 86/50
2010/0192757 A1 8/2010 Martin
2010/0194006 A1 * 8/2010 Evans ..... F23G 5/20 266/213

* cited by examiner

THERMAL DESTRUCTION ARRANGEMENT

TECHNICAL FIELD

The present invention relates to a destruction system, for example provided for allowing thermal destruction of ammunition, small arms and thereto related material. The invention also relates to a corresponding method for operating such a destruction system.

BACKGROUND OF THE INVENTION

A destruction system may be used for destroying explosive objects such as e.g. ammunition, propellants or explosives, including for example old unusable or unwanted ammunition. Such a system must be robust in order to withstand the high powers of possible unwanted detonating explosives.

An example of a destruction system is disclosed in EP0898693 where munitions are loaded in a chamber through a combined inlet/outlet. The chamber is emptied after use by rotating the chamber through 180°. A similar system is disclosed in WO96/12157.

Loading of munitions into the detonation chamber is an important part of a system for a destruction process. It is desirable to enable a user-friendly and safe way to load munitions into the chamber, and also a simple way to unload destroyed munitions out from the chamber once the destruction process has been completed. Even though the above mentioned prior art shows very useful solutions for loading and unloading of objects, it would still be desirable to even further optimize a destruction system with a dedicated, user friendly loading and unloading solution.

SUMMARY OF THE INVENTION

In view of the above mentioned need, a general object of the present invention is to provide an improved destruction system which at least to some extent provides further improvements in relation to prior art.

According to an aspect of the invention, there is provided a system for thermal destruction of munitions as defined by claim 1.

In accordance with the present invention, munitions may for example include small and medium sized ammunitions, grenades or the like, and/or propellants such as fuel, gasoline, oxidizer, rocket fuel, jet fuel etc, and/or any type of explosive object. Other types of similar objects may of course be included within the scope of the invention. Furthermore, a kiln is here understood to include a thermally insulated chamber that may produce sufficient temperature for destruction of munitions or similar. The kiln may further be configured to withstand a powerful detonation of munitions and may comprise for example a steel element for creating a robust wall. The kiln is preferably configured be operate at temperatures around e.g. 350° C. or higher.

As defined by the invention, the gate may for example be made from steel or similar for withstanding the possible detonation of explosives inside the kiln. The gate may further comprise a protruding portion for engaging with the loading tray. The engaging portion of the loading tray may for example include a hook arrangement that engages with the protruding portion of the gate.

If the kiln is in a loading position and the loading tray is rotated about its pivoting connection, then a portion of the gate may be arranged to move along an edge portion of the loading tray while rotating about its pivoting connection. At the same time, the gate is in contact with the loading tray at edge portions of the loading tray. The edge portions are advantageously such that they define an opening of the tray. This is advantageous because it allows munitions or the like to slide into the kiln as the loading tray is tilted since the gate may not block the opening of the kiln or the loading tray since it moves on the edge of the tray.

The invention is based on the understanding that loading and unloading of objects in a destruction system may be combined with locking and unlocking of the opening of the kiln. For example, by a simple motion of the loading tray for tilting an object into the kiln, the gate may automatically at the same time be locked and unlocked. Similarly, in an unloading position of the kiln reached by a rotation of the kiln, the motion of the loading tray enables extraction of waste from inside the kiln. Accordingly, advantages with the present invention include the possibility of a simple, safe and straightforward way to load and unload munitions or material to/from a kiln of a destruction system.

According to an embodiment of the invention, the system further comprise actuators arranged to exert a force on the loading tray such that the loading tray rotates about the pivoting connection, the actuators being connected to the loading tray. The actuators may advantageously be connected to the loading tray and to a portion of e.g. the kiln or a stand connected to the kiln. The actuators may advantageously be telescoping arms. The telescoping arms may be arranged such that in a compressed state, the loading tray is tilted away from the gate. In a loading position of the kiln this may allow munitions or the like to be placed in the tray without falling out. When the telescoping arms are in an extended state, and the kiln is in a loading position, the tray may be in a position such that an object placed in the tray slides into the opening of the kiln. In the expanded state of the telescoping arms, the loading tray covers the opening of the duct. The use of telescoping arms are advantageous because they are robust, easily mounted and controlled, and quickly replaced.

In a further embodiment, the duct is arranged such that an angle larger than 90° is formed at an intersection between the kiln and the duct, and such that the duct is tilted. The intersection may be at an outer surface of the kiln and one of the sides of the duct. In this arrangement, the duct extends from the kiln in a direction such that a longitudinal central axis of the duct does not intersect with the horizontal axis of the kiln. In this way the duct extends in an essentially tangential direction from an inner surface of the kiln. This is advantageous because it facilitates loading and unloading of material/objects to/from the kiln.

In an embodiment, the kiln is rotated about the horizontal axis from the first position to the second position in a direction such that the duct travels past a vertical axis of the kiln, a rotating angle being at least 120°. In other words, the kiln is configured to be rotated in a direction such that the duct travels directly above a center point of the kiln that coincides with the horizontal axis of the kiln. This is advantageous because it allows a more efficient extraction of waste material from inside the kiln because the waste naturally falls into the duct this way. Furthermore, the rotating angle from the first loading position to the second unloading position enables simple extraction of waste because the duct is arranged close to the ground in the second position.

In an implementation of the invention, the kiln may be "shaken" for facilitating emptying of the loading tray when the kiln is in a loading position and the gate is open. This may be performed by small repetitive rotations about the horizontal axis of the kiln.

A motor is advantageously arranged and configured to supply power for rotating the kiln between the first and second position. This is advantageous because it simplifies the use of the system. The motor is advantageously an electric motor, but any other types of motors work equally well.

The heating element is advantageously arranged opposite the duct with respect to the horizontal axis. This is advantageous because it allows an object that is loaded in the kiln through the duct, when the kiln is in the loading position, to land adjacent to the heating elements.

The kiln advantageously comprises a cylindrical shape. A cylindrical shape may facilitate construction of the kiln. It further facilitates arranging the duct in the kiln since the curvature of the kiln may then only be along one circumference where the kiln is arranged. The cylindrical shape may be a circumference around an outside of the kiln in the direction of a rotation of the kiln about the horizontal axis. However, the kiln may further comprise other shapes such as a spherical, a cubic or any other suitable shape.

The destruction system is advantageously arranged on a trailer for allowing mobility of the destruction system. This way, fast and simple relocation of the system is enabled. It is further advantageous because a trailer may be towed by a standard vehicle, such as e.g. a truck. The destruction system may advantageously be dimensioned such that it is mobile by any other means, such as e.g. on a truck or on wheels mounted on a separate stand on the kiln.

The destruction system may advantageously comprise a control unit configured for controlling the actuators for controlling of the loading tray, and for controlling of the motor for controlling the rotation of the kiln. This is advantageous because it allows automatic and/or remote control of the destruction system.

According to an embodiment, the destruction system comprises a camera for monitoring an amount of waste material in the kiln. This is advantageous because it allows determining if the kiln is full or if it needs to be emptied. The camera is advantageously arranged in the loading tray.

Furthermore, the system may advantageously further comprises a control unit configured for operating the destruction system. Accordingly, operation of the system may be at least partly automated, implemented as e.g. software, hardware and a combination thereof.

The control unit is preferably a micro processor or any other type of computing device. Similarly, a software executed by the control unit for operating the inventive system may be stored on a computer readable medium, being any type of memory device, including one of a removable non-volatile random access memory, a hard disk drive, a floppy disk, a CD-ROM, a DVD-ROM, a USB memory, an SD memory card, or a similar computer readable medium known in the art.

According to another aspect of the present invention there is provided a method for controlling of a system for thermal destruction of munitions as defined by claim 13. This aspect of the invention provides similar advantages as discussed above in relation to the previous aspect of the invention.

According to an embodiment, the method further comprising a step of determining an amount of waste material accumulated in the kiln, and if the amount of waste material is below a predetermined limit, determining that an additional destruction process is possible.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
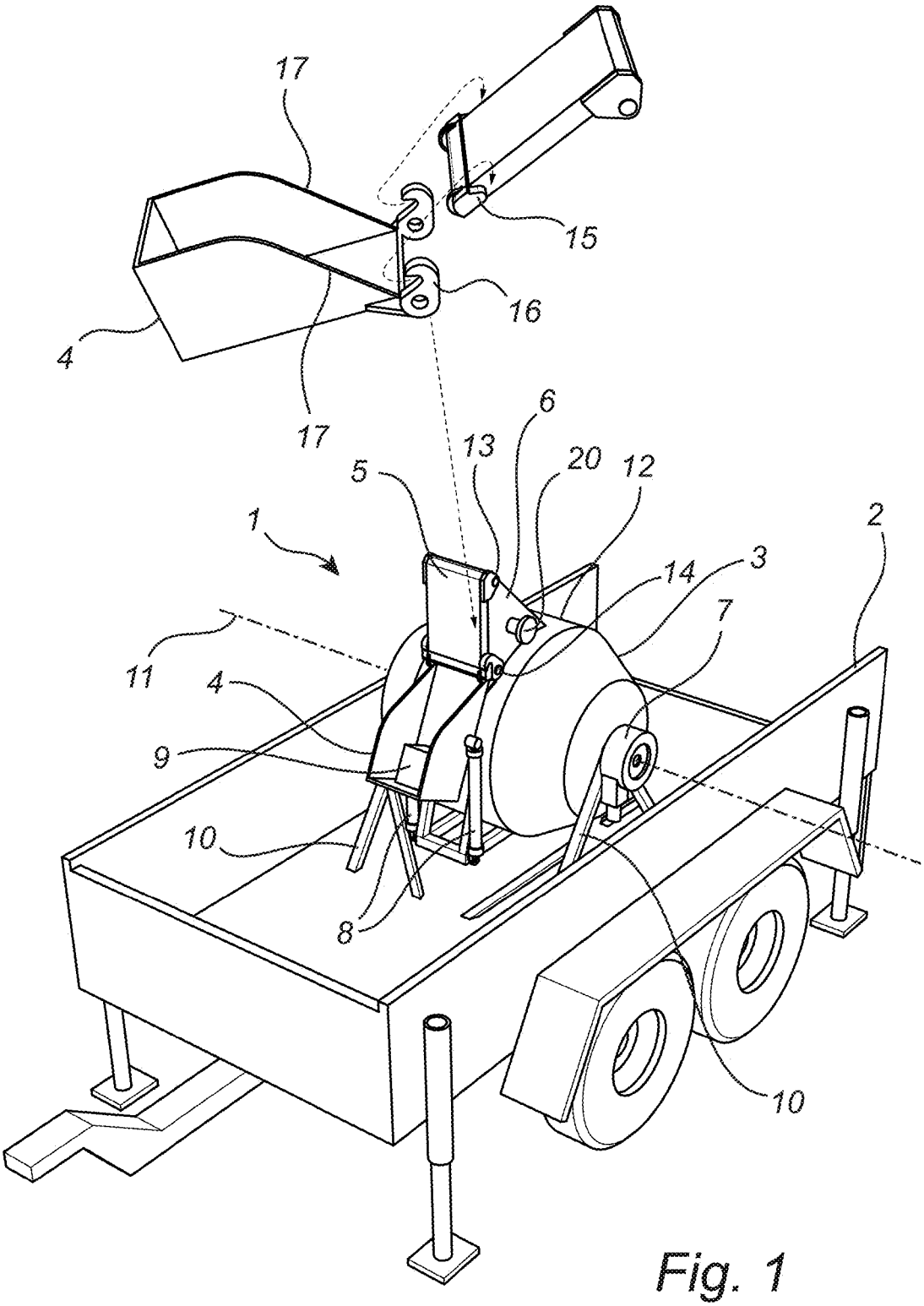
FIG. 1 shows an embodiment of a mobile destruction system arranged on a trailer.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a mobile destruction system 1 arranged on a trailer 2. In FIG. 1 there is shown a kiln 3, a loading tray 4, a gate 5, a duct 6, a kiln turning actuator 7, telescoping arms 8, a feeding box 9, and a stand 10 supporting the kiln 3.

With further reference to FIG. 1, the feeding box 9 containing munitions is placed in the loading tray 4. However, a feeding box is not necessary for the function of the system; the munitions may also be loaded directly in the loading tray without the feeding box 9. The kiln 3 is pivotally supported by a stand 10 and is in FIG. 1 shown in a loading position. There is further shown a horizontal axis 11 of the kiln 3 about which the kiln 3 is rotatable. The duct 6 extends outside the kiln 3 at an angle 12 different from a vertical angle and the duct 6 further has an opening covered by the gate 5, thus the gate 5 being in a closed position.

The gate 5 is pivotally connected to a first portion 13 of the duct 6 such that the gate 5 may rotate about the axis formed by a line intersecting the first portion 13 and a periphery of the gate 5. The loading tray 4 is pivotally connected to a second portion 14 of the duct 6. The location of the second portion 14 is closer to the kiln 3 compared to the first portion 13. The gate 5 has a protruding portion 15 on the gate 5 that can engage with an engaging portion 16 of the loading tray 4 to lock the gate 5 in a closed position. The loading tray 4 furthermore has edge portions 17 on which the gate 5 may slide as will be explained with reference to FIG. 3. There is further an exhaust 20 arranged on the duct 6. However, the exhaust may be arranged elsewhere, still connected to the kiln. For example, an exhaust may alternatively (or also) be located on the horizontal rotation axis 11, or at another location connected to the kiln 3. The exhaust may further be connected to a chimney. There may further be a filter or any other cleaning unit connected to the exhaust.

Figure 2:
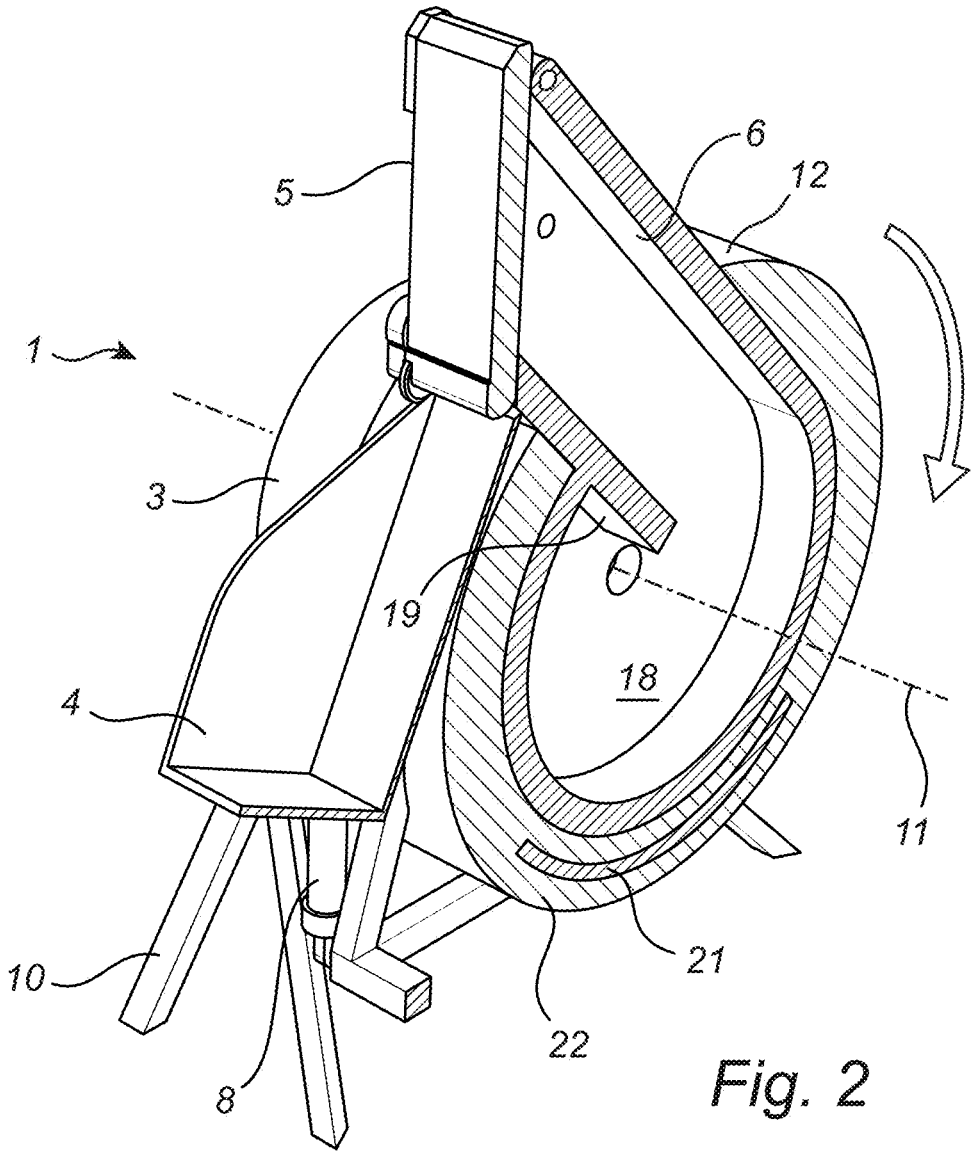
FIG. 2 shows a perspective cross-sectional view of an embodiment of a mobile destruction system.

Referring now to FIG. 2 showing a perspective cross-sectional view of the embodiment illustrated in FIG. 1. In FIG. 2, an inside compartment 18 of the kiln 3 is shown with the duct 6 extending from the inside compartment 18 to the outside of the kiln 3. A heating element 21 is located in an insulated section 22 of the kiln 3 on a side essentially opposite from the duct 6, across from the inside compartment 18. The heating element 21 is used for providing sufficient heat to munitions or explosives placed in the compartment such that the munitions or explosives are thermally destructed. A portion 19 inside the compartment 18 may at least partly protects the gate 5 from fragments resulting from a detonation inside the kiln 3. The arrow indicates a rotation direction when the kiln is rotated from a first loading position to a second unloading position, as will be explained with reference to FIG. 3A and FIG. 3B.

Figure 3A:
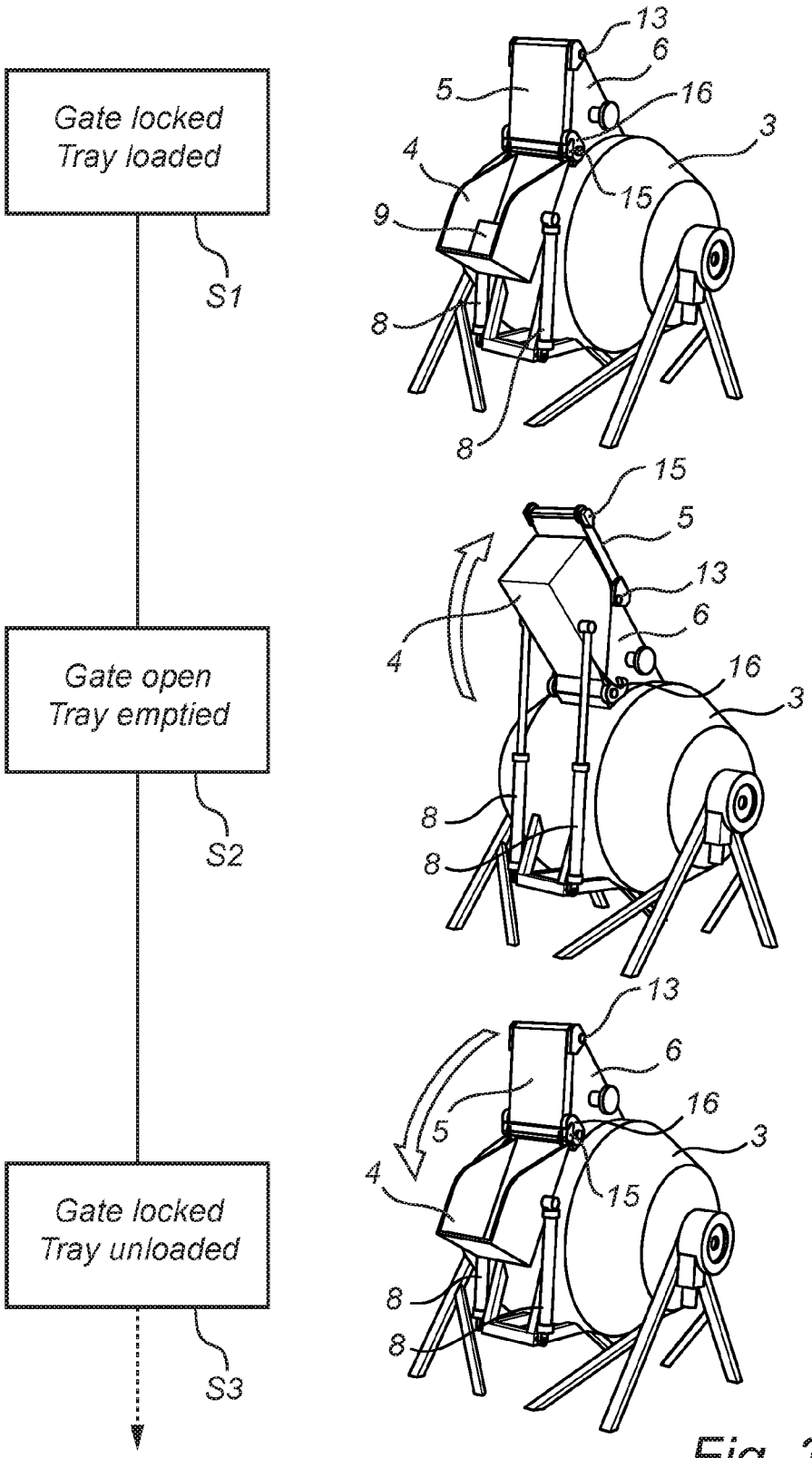
FIG. 3A and FIG. 3B provide a flow chart illustrating loading, operation, and unloading of material from an embodiment of the invention.
Figure 3B:
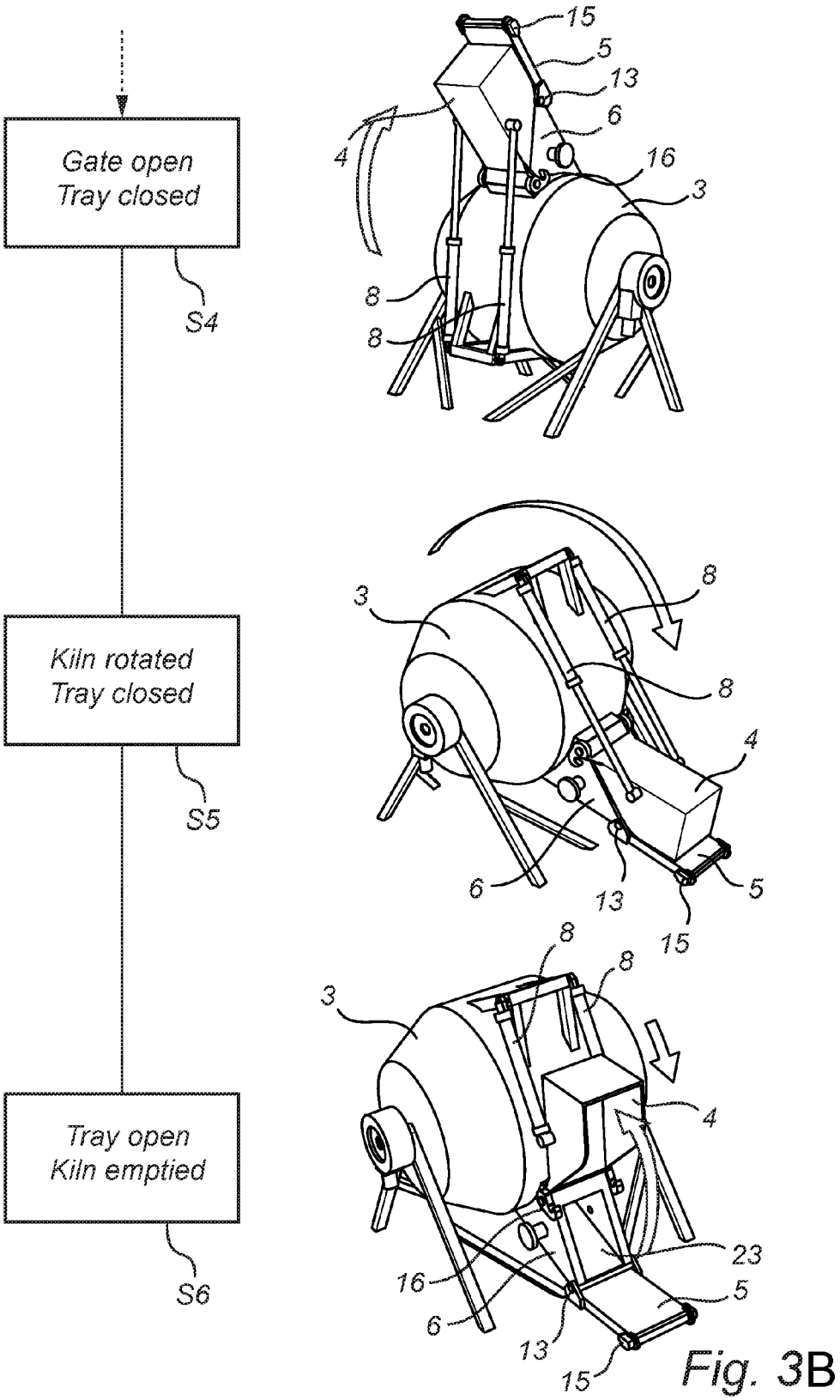

Referring now to FIG. 3A and FIG. 3B showing a flowchart illustrating a loading and unloading procedure for the destruction system 1, when in use. In an initial configuration S1 the kiln 3 is in a loading and operation position. In this position, the duct 6 is facing upwards and the opening of the duct 6 is closed by the gate 5. The loading tray 4 arranged away from the opening and a feeding box 9 comprising munitions is loaded in the loading tray 4. The amount of munitions that may be loaded for a single destruction process depends on an amount of combustible material and energy content in the munitions. In this configuration, the engaging portion 16 of the loading tray 4 engages with a protruding portion 15 of the gate 5, as was explained with reference to FIG. 1.

When the telescoping arms 8 are extended to an extended state S2, the engaging portion of the loading tray 4 releases the gate 5, and the gate 5 slides on edge portions 17 of the loading tray 4 such that the gate 5 rotates about the pivot connection at the duct 6 and such that the gate 5 is opened. The releasing of the gate 5 is realized during the first e.g. at least 10° of rotation of the loading tray. When the telescoping arms 8 are in a fully extended state the loading tray 4 covers the opening of the duct 6 and the feeding box 9 may slide into the compartment 18 of the kiln 3. In this configuration S2, the loading tray 4 is emptied. The kiln 3 may further be "shaken" for facilitating emptying of the loading tray 4 when the kiln 3 is in the loading position and the gate 5 is open.

This may be performed by small repetitive rotations about the horizontal axis 11 of the kiln. After the loading tray 4 is emptied, the loading tray 4 is moved back to the position where the gate 5 is locked, however, now the tray 4 is empty. The system 1 is now in an operation state S3 and the kiln 3 is preferably kept in this operation position until a destruction process has been completed. Such a process may take, but is not limited to, for example 3-20 minutes. After this, the kiln may be loaded again for completing an additional destruction process.

Several destruction processes may be performed before the kiln needs to be unloaded. This is determined by an amount of waste material, such as e.g. metal pieces that is accumulated in the kiln. The amount of waste material may be determined by e.g. a camera mounted for example on the loading tray such that a user may see the inside of the kiln with the camera.

After one or several destruction processes are completed, the tray 4 is moved back to the first position S4 in which the gate 5 is open and the loading tray 4 covers the opening of the duct 6. In this configuration, the above-mentioned camera that may be mounted on the loading tray may be used to determine the amount of waste material accumulated in the kiln. Now, the kiln 3 is rotated in to an unloading position S5. The rotation is performed such that the duct 6 travels above the center of the kiln 3. The kiln 3 is rotated at least 120°, but most preferably 150°. The loading tray 4 still closes the opening of the duct 6.

Finally S6, the telescoping arms 8 are compressed and pull the loading tray 4 away from the opening of the duct 6. Due to gravity, with the kiln 3 in the unloading position, the gate 5 will not follow the loading tray 4 as it moves away from the opening. After the loading tray 4 has been fully withdrawn, the kiln 3 can be rotated an additional angle, for example 10°, for facilitating extraction of waste material from the kiln 3. Thereafter, the kiln 3 is emptied through the opening 23 in the duct. The kiln 3 may further be "shaken" for facilitating emptying of the kiln 3 when the kiln 3 is in the unloading position and the gate 5 is open. This may be performed by small repetitive rotations about the horizontal axis 11 of the kiln.

Variations to the disclosed embodiments can be understood and effected by the skilled addressee in practicing the claimed invention, from a study of the drawings, the disclosure, and the appended claims. For example, the kiln may have other shapes than illustrated in the drawings, it should also be understood that the word "munitions" includes any explosive or similar material appropriate for the destruction system, the angles mentioned in the text are not limited to the mentioned angles, for example, the kiln may be rotated an angle outside the interval 120°-160° as long as the appropriate effect occurs. In the description a feeding box is mentioned to hold the munitions. The invention is equally applicable without the feeding box, in other words, the munitions may be loaded directly in the loading tray without the feeding box. That is, the word "feeding box" may be replaced by "munitions". The gate may further comprise an actuator for opening/closing the gate as an additional force adding to gravity. This is advantageous in case the gate is prevented from fully closing during normal operation. Furthermore, in the claims, the word "comprising" does not exclude other elements or steps, and the indefinite article "a" or "an" does not exclude a plurality.

The invention claimed is:

1. A system for thermal destruction of munitions, the system comprising:

a kiln rotatable about a horizontal axis, the kiln comprising an electrical heating element, wherein the kiln is arrangeable in a first loading and operating position and in a second emptying position;

a duct arranged to form an opening in the kiln;

a gate having a first end connected by a pivot connection to a first portion of the duct; and a loading tray pivotally connected at a second portion of the duct opposite the first portion, the loading tray being arranged such that the gate is in contact with edge portions of the loading tray when the kiln is arranged in the first position;

wherein when the kiln is arranged in the first position and when the loading tray is arranged away from the opening, the gate covers the opening, and a portion of the loading tray engages with a portion of the gate to lock the gate in a closed position, wherein when the kiln is arranged in the first position and when the loading tray is rotated about the pivot connection, the gate is unlocked and rotated about the pivot connection of the gate in such a way that the gate opens the opening, and such that the loading tray is tilted towards the opening of the kiln such that munitions placed in the loading tray fall into the kiln through the opening, and wherein when the kiln is arranged in the second position the kiln is arranged such that material from an inside of the kiln fall through the duct, and the gate is further arranged such that when the loading tray is returned to being arranged away from the opening, the gate loses contact with the edge portions of the loading tray.

2. The system according to claim 1, further comprising actuators arranged to exert a force on the loading tray such that the loading tray rotates about the pivoting connection, the actuators being connected to the loading tray.

3. The system according to claim 2, further comprising:

a control unit configured for controlling the actuators for controlling of the loading tray and the motor for controlling the rotation of the kiln.

4. The system according to claim 3, further comprising a camera for monitoring an amount of waste material in the kiln.

5. The system according to claim 4, wherein the camera is arranged in the loading tray.

6. The system according to claim 1, wherein a motor is arranged and configured to supply power for rotating the kiln between the first and second position.

7. The system according to claim 1, wherein the duct is arranged such that an angle larger than 90° is formed at an intersection between the kiln and the duct, and such that the duct is tilted towards the loading tray with respect to the kiln.

8. The system according to claim 1, wherein the edge portion defining an opening of the loading tray.

9. The system according to claim 1, wherein the kiln is rotated about the horizontal axis from the first position to the second position in a direction such that the duct travels past a vertical axis of the kiln, a rotating angle being at least 120°.

10. The system according to claim 1, wherein the heating element is arranged essentially opposite the duct with respect to the horizontal axis.

11. The system according to claim 1, wherein the kiln comprises a cylindrical shape.

12. The system according to claim 1, wherein the system is mobile.

13. A method for controlling of a system for thermal destruction of munitions, the system comprising:

a kiln rotatable about a horizontal axis;

a duct arranged to form an opening in the kiln;

a gate pivotally connected to the duct and arranged to open and close the opening of the duct; and a loading tray connected by a pivot connection to the duct such that the gate is in contact with edge portions of the loading tray when the kiln is arranged in a first position, wherein a portion of the loading tray engages with a portion of the gate to lock the gate in a closed position;

the method comprising:

rotating, when the kiln is in the first loading position, the loading tray about the pivot connection in a first direction such that the gate is unlocked and opened and the loading tray is tilted towards the opening of the kiln;

rotating, when the kiln is in the first loading position, the loading tray about the pivot connection in a second direction opposite the first direction such that the gate is closed and the loading tray is tilted away from the opening of the kiln, and such that the portion of the loading tray engages with the portion of the gate to lock the gate in a closed position;

performing a destruction process;

rotating, when the loading tray is tilted towards the opening such that the loading tray covers the opening, the kiln into a second unloading position, and rotating, when the kiln is in the second unloading position, the loading tray about the pivot connection in the first direction such that the loading tray is tilted away from the opening of the kiln, and such the gate looses contact with the edge portions of the loading tray, wherein the gate is in an open position.

14. The method according to claim 13, wherein the system further comprises a control unit configured for performing the steps of operating the destruction system.

* * * * *